United States Patent [19]

Simm et al.

[11] Patent Number: 4,726,521

[45] Date of Patent: Feb. 23, 1988

[54] PROCESS FOR THE PRODUCTION OF ELECTRICALLY CHARGED SPRAY MIST OF CONDUCTIVE LIQUIDS

[75] Inventors: Walter Simm; Friedrich-Wilhelm Kremer, both of Leverkusen, Fed. Rep. of Germany

[73] Assignee: Bayer Aktiengesellschaft, Fed. Rep. of Germany

[21] Appl. No.: 874,408

[22] Filed: Jun. 16, 1986

[30] Foreign Application Priority Data

Jun. 27, 1985 [DE] Fed. Rep. of Germany ..... 3522979

[51] Int. Cl.[4] ..... E01B 1/00; B05B 1/00; B05B 1/26

[52] U.S. Cl. ..... 239/3; 239/122; 239/518; 239/524; 239/697; 239/698

[58] Field of Search ..... 239/3, 4, 102.2, 120, 239/121, 122, 518, 524, 690, 697, 698

[56] References Cited

U.S. PATENT DOCUMENTS

| | | | |
|---|---|---|---|
| 426,512 | 4/1890 | Parker | 239/121 |
| 1,830,709 | 11/1931 | Mouron | 239/122 |
| 1,876,669 | 9/1932 | Harlow | 239/524 X |
| 2,658,582 | 11/1953 | Wintermute | 239/698 X |
| 3,131,131 | 4/1964 | Wehner | 239/690 X |
| 4,310,474 | 1/1982 | Iyengar | 239/697 X |
| 4,407,450 | 10/1983 | Chegolya | 239/518 |
| 4,431,382 | 2/1984 | Edman | 239/121 X |
| 4,544,570 | 10/1985 | Plunkett et al. | 239/690 X |
| 4,560,107 | 12/1985 | Inculet | 239/690 X |

*Primary Examiner*—Andres Kashnikow
*Assistant Examiner*—Patrick N. Burkhart
*Attorney, Agent, or Firm*—Connolly and Hutz

[57] ABSTRACT

The spray mist is produced by ejecting the liquid from one or more nozzles (1) in the form of jets (2) disintegrating into drops and the liquid formed from the drops is then conveyed to a spray system (4) which is electrically insulated from the nozzles (1) and a powerful electric field is applied between the nozzles (1) and the spray system (4). A spherical impact electrode or a two-material spray nozzle insulated against earth under a high voltage may be used as spray system. The main advantage is that the smooth jet nozzle (1) and hence also the container for the liquid to be sprayed are at earth potential.

11 Claims, 5 Drawing Figures

PROCESS FOR THE PRODUCTION OF ELECTRICALLY CHARGED SPRAY MIST OF CONDUCTIVE LIQUIDS

This invention relates to a process for producing electrically charged spray mist of conductive liquids.

An electrostatic spray process for organic plant protective formulations having specific resistances in the region of $\rho = 10^4$ Ohm.m to $\rho = 10^7$ Ohm.m is known but the electric resistance of the most commonly used aqueous plant protective agent is much lower, with $\rho < 10^2$ Ohm.m. Aqueous formulations of this kind require a supply of mechanical energy for spraying and special measures must be taken to supply them with an additional electric charge. This may be achieved, for example, by putting the spray elements such as fine nozzles or rapidly rotating discs under a high voltage. The electric forces which deposit the charged droplets in all directions on to their target, e.g. a plant, are only effective if the droplets produced are small. Thus, for example, water droplets having a diameter of 200 μm can be efficiently deposited on conductive, earthed objects under a high charge and under these conditions the electric forces predominate considerably over gravity.

It is found in practice that the most favourable conditions for charging droplets are obtained when the spray elements themselves are put under a high voltage so that the droplets produced carry a charge of the same sign as the nozzle potential. In that case, the droplets are repelled by the spray element and attracted by the counter-electrode.

One disadvantage of this arrangement is that if the liquids are conductive, the high voltage of the spray element is transmitted to the container for the liquid through the column of liquid in the supply tube. If the quantities of liquid are small, as in simple hand spray devices. then the container can easily be insulated against the high voltage. If the rate of supply of liquid is low, the container may itself be earthed and a very long, thin insulating tube may be used as a connection to the nozzle or spray disc. The liquid column will assume such a high resistance in this tube that even when the nozzle is under a voltage of several kilovolt only a very weak earth current, for example of less than 1 mA will flow through the liquid column.

The use of fine nozzles, e.g. with a diameter of 100 μm, which may be very advantageous for producing monodisperse droplets, is restricted to liquids which do not produce a deposit on the capillary wall (e.g. line from tap water) and do not crystallise (active ingredients dissolved to a high concentration may form crystal deposits), and to dispersions which only contain particles substantially smaller than the diameter of the nozzle.

Impurities of this kind are much less critical if electrodes rotating at a very high speed are used but the expense of the apparatus is then very high.

It is thus an object of the present invention to develop a simple process for producing relatively large quantities of fine, electrically highly charged droplets of conductive liquids which does not require any mechanically rapidly moved electrodes nor the use of fine nozzles and which in particular will operate in such a manner that relatively large containers for the liquid to be sprayed will not be under an electric potential so that complicated measures for dealing with the problem of insulation will not be required.

This problem is solved according to the invention by delivering the liquid to be sprayed through one or more nozzles in the form of jets disintegrated into droplets and then conveying the liquid formed from the droplets to a spray system which is electrically insulated from the nozzles, a powerful electric field being applied between the nozzles and the spray system.

It has surprisingly been found that when this arrangement is employed, streams of liquid can be transmitted through water jets or jets of other conductive liquids up to a certain strength of jet over distances of a few centimeters from earthed nozzles to electrodes which are under a high potential (e.g. 20 to 40 kV) without causing spark ignition between the nozzle and electrode or releasing equalizing currents. When simple smooth jet nozzles and relatively low speeds of flow are used, the initially coherent part of a liquid jet disintegrates into a row of drops after a short distance if emitted within a given range of speed, and the current discharge is thereby interrupted.

It has long been known that when the drops of a jet of liquid impinge on a hard surface they are broken down into a large number of much smaller droplets. This effect can be used for obtaining very small droplets from the relatively large droplets which are emitted from nozzles by the natural disintegration of a liquid jet. The possibility of directing liquid jets of a certain type towards electrodes carrying a high voltage without producing any significant flow of current gives rise to the further possibility of producing small, highly charged droplets from relatively wide nozzles by this impact effect if suitable electrode arrangements are provided. Wide nozzles are always preferable to narrow capillary nozzles as they are much more reliable in use. The electric charges on the small droplets are obtained if the point of impact of the primary drops of a jet lies in a region in which a powerful electric field is maintained. In such a field directed perpendicularly to the surface of impact, the reflected droplets take up a contact charge which is transmitted to the drops of the jet under the same principle as the transfer of charge from a nozzle which is under electric potential.

The new principle described here has, however, the great advantage that the nozzle and hence also the container for the liquid can be kept at earth potential, as desired, and only a simple impact electrode which can easily be fixed in an insulated arrangement need be put under a high voltage.

The field strength required at the point of impact on the high voltage electrode for charging up the droplets can be increased to the maximum possible value by various means. One of these consists of making the jet impinge on a curved electrode surface by using an electrode in the form of a sphere or a cylinder.

A powerful field over the point of impact is also obtained by placing an earthed field electrode over this point. This field electrode may be in the form. for example, of a hollow cylinder enclosing the first part of the liquid jet emerging from the nozzle. The reduction of the distance of the electrodes near the point of impact concentrates the field at this point.

Electrically shielding the jet by a surrounding cylindrical electrode which is at the same potential not only increases the field strength but also focuses the jet. Whereas without this shield the primary droplets of the jet would also take up a charge from the nozzle by influence and would be pushed apart by mutual repulsion so that the targeted impact would be impaired, this charging of the primary droplets does not take place in the presence of the cylindrical shield and the impact of the droplets can be more accurately concentrated at one point.

Under operating conditions which are relevant for practical purposes, i.e. when low liquid pressures of only a few bar are used, only a fraction of the liquid in the jet is atomized by the impact effect. The remainder flows over the electrode surface to the deepest point of the electrode and drips down from there. This proportion of liquid which is not atomized is relatively large and may, for example, amount to as much as 50% of the total quantity. This liquid must be collected and returned to the nozzle by a pump system. Since the impact electrode from which the liquid drips is under a high voltage but the devices collecting the liquid must remain at earth potential for practical reasons, the problem again arises of transferring liquid between electrodes which are under a voltage. Since in this case, however the liquid that drips off is not under pressure, it cannot be concentrated into a narrow jet with a low charge transport. Instead, this liquid tends to collect at a certain point and then flow off in wider streams. This leads to immediate spark discharge and short circuiting.

It has now been found that by using suitable drip electrodes, the liquid dripping off can be distributed so that no coherent streams will form and the liquid will drip off at several points simultaneously and, in addition, the electric forces will act on the liquid to disintegrate it into smaller droplets which will not form a short circuiting bridge. The distance between the drip electrode and the collecting element for the liquid may thereby be reduced to a few centimeters.

The liquid under electric potential may be arranged to drip off from a toothed lower edge of the electrode, for example. In such an arrangement, the distance between the tip of one tooth and the next plays an important part. Distributor elements of known type, e.g. an overflow channel and conductive strip for the liquid, supplies partial streams of liquid to the individual teeth. If the impact electrode has the form of a cylinder, for example, with the cylinder axis placed horizontally, then a toothed strip with downwardly directed teeth may be used as dripping element, which will be placed at the lowest surface line of the cylinder with the tips of the teeth set at intervals of 5 to 10 mm, preferably 6 to 8 mm. A horizontal channel is cut into the cylindrical body along a higher surface line of the cylinder and the required points of overflow are marked by notches on the edge of the channel.

The mode of operation of the process is explained below with the aid of examples illustrated in FIGS. 1 to 5.

Figure 1:
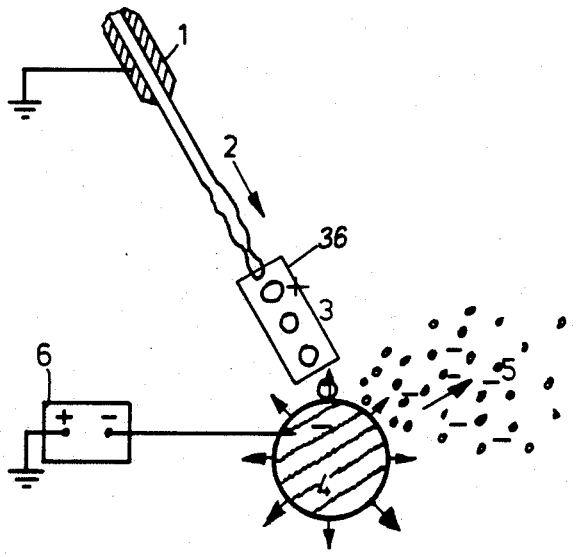
FIG. 1 illustrates the principle of formation of charged droplets.

In FIG. 1, a liquid jet 2 is ejected from a smooth jet nozzle 1 and naturally disintegrates into a row of drops due to surface tension. The disintegration of a jet of liquid into individual drops is observed whenever a smooth jet of liquid is emitted from a nozzle at a relatively low speed of flow. This effect, which has been known for a long time, is termed "natural jet disintegration". A full account may be found, for example, in the article by P. Schmidt and P. Walzel in Chem. Ing. Tech. 52 (1980) No. 4, pages 304 to 311. The droplets thus produced encounter the spherical impact electrode 4 where they are broken down to be re-emitted as a swarm of droplets 5. The electrode 4 is connected to a source of voltage 6 to receive a negative potential with respect to earth. The nozzle 1 is earthed. In the process indicated here, the individual drops of the row 3 assume a positive contact charge by influence and move towards the negative spherical electrode. As soon as the drops make contact with the sphere they give up their positive charge to the sphere and the liquid on the surface of the sphere becomes negatively charged and retains this charge even when it leaves the sphere in the cloud of droplets. The arrows indicate the direction of the field on the surface of the sphere.

FIG. 1 also illustrates the feature of the present invention wherein a powerful field over the point of impact of the liquid on the impact electrode is obtained by placing an earthed field electrode 36 over this point. Field electrode 36 is in the form of a hollow cylinder enclosing the forward portion of the liquid jet emerging from nozzle 1. Reduction of the distance of the electrodes near the point of impact concentrates the field at this point.

Figure 2:
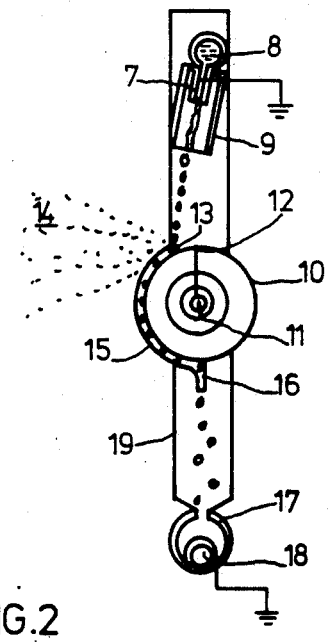
FIG. 2 shows the path of the droplets between the nozzle, the impact electrode and the collecting element.

FIG. 2 shows a smooth jet nozzle 7 from a row of nozzles having a common inlet 8. The cylindrical shield 9 surrounds the nozzle and the first part of the liquid jet up to the point at which disintegration into individual drops has already set in. The point of separation at which the first drop is released from the jet is therefore free from the electric field and the drops do not become charged. The middle part of the drawing shows the cylindrical impact electrode in section. This electrode 10 is connected to a source of high voltage (not shown) by a high voltage cable 11 and the internal connecting point 12. The point of impact 13 of the liquid jet is offset from the middle of the electrode so that the swarm of droplets is ejected sideways, preferably in a horizontal direction. The portion of liquid 15 which is not atomized becomes distributed in a spreading layer (assisted by distributor elements) over part of the surface of the cylinder and finally reaches the toothed strip 16 from which it drips at several points. The drops are further disintegrated by a powerful electric field in the region of the tips of the teeth and drawn into a receiving vat 17 where the liquid collects to be sucked off through the pipe 18. The parts of the apparatus described are held in the position illustrated by supporting bars 19.

Figure 3:
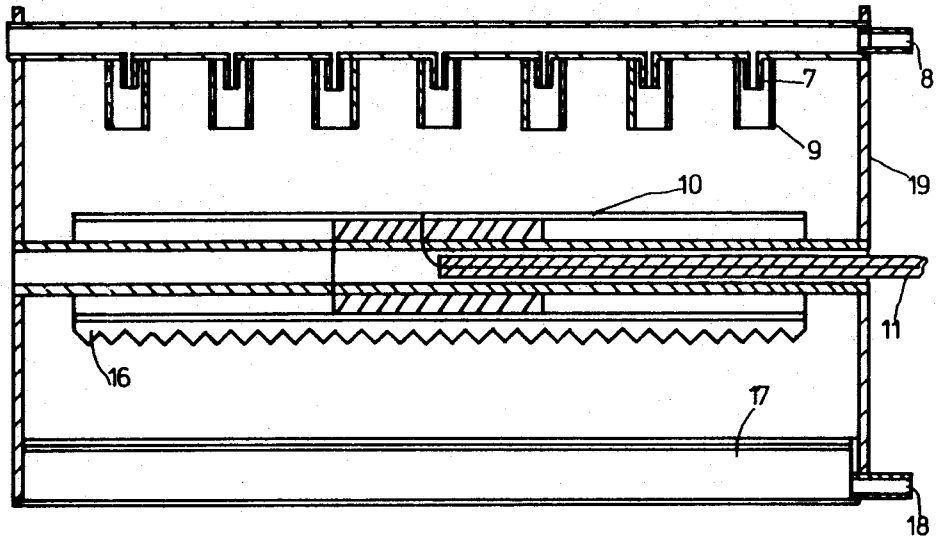
FIG. 3 shows an electrode arrangement for a plurality of nozzles.

Another view of the arrangement is shown in FIG. 3, where several nozzles 7 and the same number of cylindrical shields 9 are shown connected to the pressure pipe 8. In this view, the toothed strip 16 is visible on the lower part of the impact cylinder. The diameter of the cylinder may be 10 to 100 mm and is advantageously in the range of 15 to 30 mm. The size of the secondary droplets formed by impact of the jet depends on the width of the nozzles 7. When the nozzles have a width of 350 μm and the liquid pressure is 2 bar. for example, the droplets may predominantly have a diameter of 50 μm. The distances between the nozzles and the impact electrode and between the dripping bar and the receiving vat may be in the region of 70 to 100 mm when the operating voltage of the installation is in the region of 20 to 40 kV. The current taken up by each nozzle is in the range below 100 microamperes.

Figure 4:
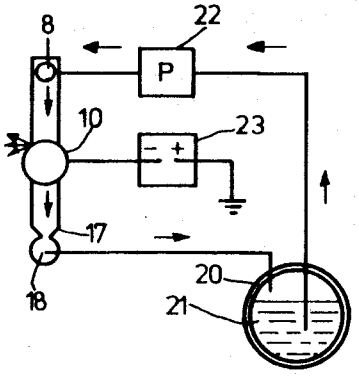
FIG. 4 shows the path of the liquid in the whole arrangement.

FIG. 4 gives an overall view of the connection of all the parts of a complete spray installation. The liquid 21 is drawn from a closed container 20 by the pump 22 and conveyed to the nozzles via the pressure pipe 8. The portion of liquid which is not atomized is returned to the container 20 by way of the suction pipe 18. Since the volume of liquid withdrawn is always greater than the volume returning, the liquid container which is otherwise closed on all sides is always kept under slight vacuum and there is no risk of the receiving vat 17 overflowing. The whole system contains only one high voltage electrode 10 which is connected to the source of voltage 23. All other parts are earthed. The electric capacity of the installation can therefore be kept small and dangerous charges can be avoided. The whole circulation of liquid is maintained by a single pump at a low operating pressure.

The light weight of the spray system enables the spray zone to be easily extended to a length of several meters.

Figure 5:
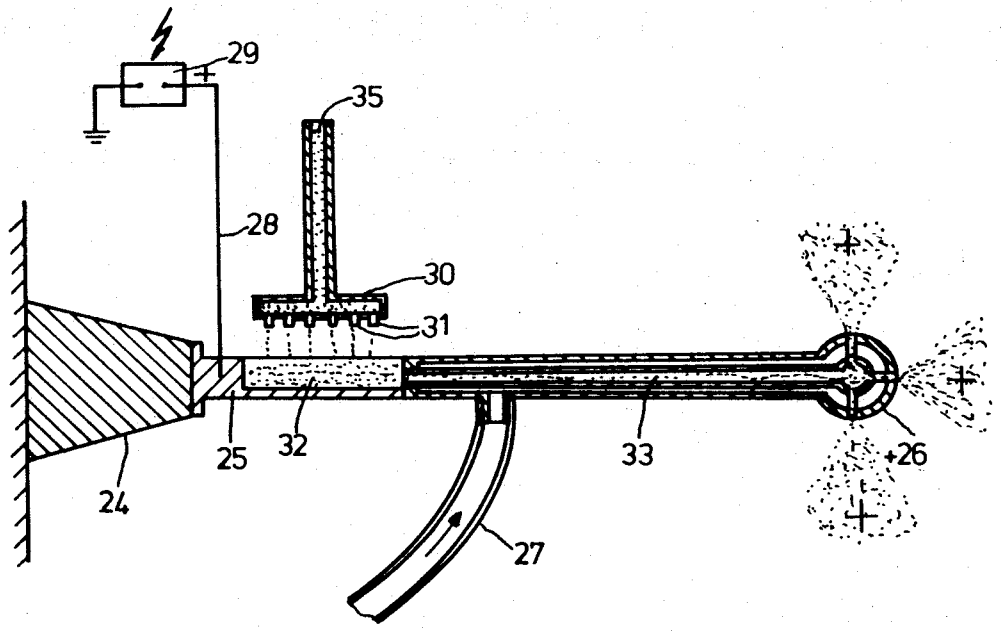
FIG. 5 illustrates another apparatus operating by the process according to the invention for spraying larger quantities of liquid.

FIG. 5 shows an apparatus for application of the process to the transfer of liquid to high voltage atomization electrodes for producing larger quantities of fine, electrically charged spray mist. In this variation, the liquid is not atomized by impact but by air streams in two-material nozzles. Apparatus of this kind may be used, for example, in agriculture for applying plant protective agents over large areas of plants or in the lacquer industry for applying coatings.

A cylindrical carrier 25 for the spray system is mounted on an insulating support 24. Mounted on the other end of the carrier pipes is a spherical or optionally cylindrical spray electrode 26 having several two-material nozzles attached to the walls on the inside so that the liquid can be sprayed outwards from each nozzle in the form of a solid cone. Three such spray points are shown in FIG. 5. The air required for operating the nozzles is supplied through a pressure tube 27 having a wall of insulating material (plastics). The carrier pipe 25 and the electrode 26 are connected to a high voltage generator 29 by a high voltage cable 28.

Since the liquid which is to be atomized is conductive, an electric separating system 30 is required in the liquid supply pipe. In this separating system, the liquid is ejected in thin jets, for example each 0.2 to 1.5 mm in thickness, from a row of smooth jet nozzles 31 and collected in a receiving vat 32 which communicates with the nozzle head 26 through the pipe 33 (self-priming nozzles). The liquid jets may extend over lengths of, for example, 100 to 200 mm.

The liquid is supplied to the separating system 30 through the pipe 35 at a slight excess pressure. The self-priming atomizer nozzles in the spray head 26 operating with compressed air draw the liquid out of the vat 32 through the pipe 33 to produce in each case a solid cone of charged spray mist. The droplets are deposited on the surfaces of all objects which are in the vicinity of the nozzles and either oppositely charged or at earth potential.

16 Smooth jet nozzles having a width of 1 mm placed in the separating system 30, for example, are capable of transmitting 4 l of water per minute at a voltage of 40 kV to a spray system. The discharge of current to earth under these conditions is less than 0.08 mA.

We claim:

1. A process for producing an electrically charged spray mist of a conductive liquid comprising the steps of emitting the conductive liquid in jet form from at least one grounded nozzle, disintegrating the jet of conductive liquid into drops, directing the drops onto a collector electrically insulated from the grounded nozzle, applying a strong electric voltage to the collector and thereby creating a strong electric field between the grounded nozzle and the collector, and spraying the conductive liquid which has now acquired the same electrical charge as the polarity of the collector onto a desired target.

2. A process as claim 1 wherein the collector comprises at least one impact electrode onto which the drops of conductive liquid are directed.

3. A process as claim 2 wherein the impact electrode has a curved surface.

4. A process as in claim 3 wherein the impact electrode is spherical.

5. A process as in claim 3 wherein the impact electrode is cylindrical.

6. A process as in claim 1 including the step of increasing the field strength over the point where the liquid drops impact upon the collector by a field electrode positioned in the vicinity of this point.

7. A process as in claim 6 wherein the field electrode is a hollow cylinder enclosing at least a portion of the liquid jet.

8. A process as in claim 2 including the step of preventing the formation of continuous streams of liquid dropping from the impact electrode by providing dripping elements on the underside of the impact electrode.

9. A process as in claim 8 wherein the dripping elements comprise toothed strips having teeth arranged at intervals of 5 to 10 mm.

10. A process as in claim 9 wherein the teeth are arranged at intervals of 6 to 8 mm.

11. A process as in claim 1 wherein the collector includes two-material nozzles for the atomization of liquid.

* * * * *